US007422400B2

(12) United States Patent
Hsieh

(10) Patent No.: US 7,422,400 B2
(45) Date of Patent: Sep. 9, 2008

(54) FASTENER FOR SECURING A CARGO CONTAINER

(76) Inventor: Jung-Kuang Hsieh, 3F, No. 2, Chin-Chung Street, Taichung City (TW)

( * ) Notice: Subject to any disclaimer, the term of this patent is extended or adjusted under 35 U.S.C. 154(b) by 412 days.

(21) Appl. No.: 11/223,596

(22) Filed: Sep. 9, 2005

(65) Prior Publication Data

US 2006/0280549 A1 Dec. 14, 2006

(30) Foreign Application Priority Data

Jun. 9, 2005 (TW) ..... 94119036 A

(51) Int. Cl.
*B63B 25/24* (2006.01)

(52) U.S. Cl. ..... 410/85

(58) Field of Classification Search ..... 410/101, 410/102, 106, 81, 84, 85, 96, 97, 100; 248/499; 403/43, 166, 291; 114/75; 24/298, 68 CD, 24/265 CD See application file for complete search history.

(56) References Cited

U.S. PATENT DOCUMENTS 1,005,301 A * 10/1911 Pipher ..... 403/166
1,974,686 A * 9/1934 Meyercord ..... 410/84
3,343,858 A * 9/1967 Rice ..... 403/229
3,719,377 A * 3/1973 Schultz et al. ..... 403/44
3,782,774 A * 1/1974 Sturek ..... 296/167
6,065,914 A * 5/2000 Fotou ..... 410/3
7,219,951 B2 * 5/2007 Rasmussen ..... 296/156
2005/0191118 A1 * 9/2005 Kay ..... 403/48
2006/0088394 A1 * 4/2006 Bruun ..... 410/85

* cited by examiner

*Primary Examiner*—Hi Gutman
(74) *Attorney, Agent, or Firm*—Baker & Daniels LLP

(57) ABSTRACT

A fastener for securing a cargo container includes a hollow connector, a first pull rod, a second pull rod and an elastic element. The hollow connector includes first and second members provided with first and second bores, respectively, and a receiving cavity between the first and second end members. The first pull rod extends through the first bore into the cavity, while the second pull rod extends through the second bore into the cavity and has a retaining head attached thereto. The elastic element is disposed around the second pull rod between the second end member and the retaining head for biasing the retaining head to move away from the second end member. The receiving cavity is open to expose the elastic element and the retaining head. The fastener may further include a limiting unit to prevent distorted movement of, and a pressure-equalizing member to evenly distribute pressure on, the elastic element.

8 Claims, 10 Drawing Sheets

FASTENER FOR SECURING A CARGO CONTAINER

CROSS-REFERENCE TO RELATED APPLICATION

This application claims the priority of Taiwanese Invention Patent Application No. 094119036 filed Jun. 9, 2005.

BACKGROUND OF THE INVENTION

1. Field of the Invention

The present invention relates to a fastener, more particularly to a fastener for securing and positioning a container on the deck of a cargo vessel or ship.

2. Description of the Related Art

Generally, when containers are being transported in a cargo vessel or ship, the containers are stacked on the deck of the ship and secured by fasteners in order to prevent undesired movement or toppling down of the stacked containers. FIG. 1 shows a stack of containers 71 secured to deck fittings on a deck 72 of a ship by fasteners 1 of the type shown in FIGS. 2 and 3. The conventional fastener 1 as shown in FIGS. 2 and 3 includes a hollow tubular connector 11, an elastic element 12, a first pull rod 13 and a second pull rod 14.

The hollow tubular connector 11 is formed by a cylindrical wall 112 enclosing an internal cavity 111 and having two opposed ends, a first bore 113 being formed at one of said opposed ends and a threaded second bore 114 being formed at the other one of said opposed ends. A filling hole 115 is formed on the cylindrical wall 112 in communication with the internal cavity 111 for introducing lubricant therein.

As shown in FIGS. 1 and 3, the first pull rod 13 includes a stem 132 having one end extending through the first bore 113 into the cavity 111 and another end adapted to be fastened onto the container 71, and a retaining head 131 attached to the one end of the stem 132 positioned in the cavity 111. The second pull rod 14 has one end extending threadedly through the second bore 114 into the cavity 111, and another end adapted to be tied to deck fittings on the deck of a ship.

The elastic element 12 is received in the cavity 111 of the connector 11 and is disposed around the stem 132 of the first pull rod 13 to exert a biasing force against the retaining head 131.

When the ship pitches and rolls in a stormy sea thus swaying the stacked containers 71, the elastic element 12 utilizes its own elastic restoring force to push against the retaining head 131 of the first pull rod 13 in a direction opposite the pulling direction of the first pull rod 13, thereby providing a tightening tension between the first and the second pull rods 13,14. Thus, no loosening or disengagement of the pull rods 13,14 from the connector 11 occurs in the course of the swaying motion of the ship.

However, while lubricant may be injected into the filling hole 115 to promote smoothness of compression and expansion of the elastic element 12, only liquid lubricants can be used due to the limited size of the filling hole 115. Such limitation in use is certainly a disadvantage.

Furthermore, in order to avoid interference with the smoothness of the sliding movement of the retaining head 131 of the first pull rod 13, the diameter of the internal cavity 111 of the connector 11 must be made slightly larger than the size of the retaining head 131. This will cause a larger gap (space) to be formed between the elastic element 12 and the cylindrical wall 112, which in turn could easily cause distortion and dislocation of the elastic element 12 to occur when the elastic element 12 is being compressed by the retaining head 131. When the fastener 1 is under a considerably large pulling tension, the elastic element 12 can easily deform and fracture, thus leading to ineffective fastening. Since the elastic element 12 is hidden within the connector 11, the condition of compression of the elastic element 12 cannot be viewed. In view of this, failure of the elastic element 12 cannot be observed from the outside, and this could be dangerous.

SUMMARY OF THE INVENTION

Therefore, a main object of the present invention is to provide an improvement over a fastener of the type described above in which the elastic element therein is exposed for immediate viewing and is well constraint to prevent distortion or dislocation thereof during use.

Accordingly, the present invention provides a fastener for fastening a cargo container which comprises a hollow connector including opposed first and second end members, a receiving cavity between the first and second end members, the first end member having a first bore and the second end member having a second bore; a first pull rod having an end extending threadedly through the first bore into the receiving cavity; a second pull rod extending threadedly through the second bore into the receiving cavity, a retaining head being attached to the second pull rod; and an elastic element 3 disposed around the second pull rod between the second end member and the retaining head for biasing the retaining head to move away from the second end member, wherein the receiving cavity is open to expose the elastic element and the retaining head.

Preferably, the fastener according to the present invention further include a limiting unit disposed between the retaining head and the second end member outwardly of the elastic element for preventing the elastic element from moving distortedly.

BRIEF DESCRIPTION OF THE DRAWINGS

Other features and advantages of the present invention will become apparent in the following detailed description of the preferred embodiment with reference to the accompanying drawings, in which.

DETAILED DESCRIPTION OF THE PREFERRED EMBODIMENTS

Figure 1:
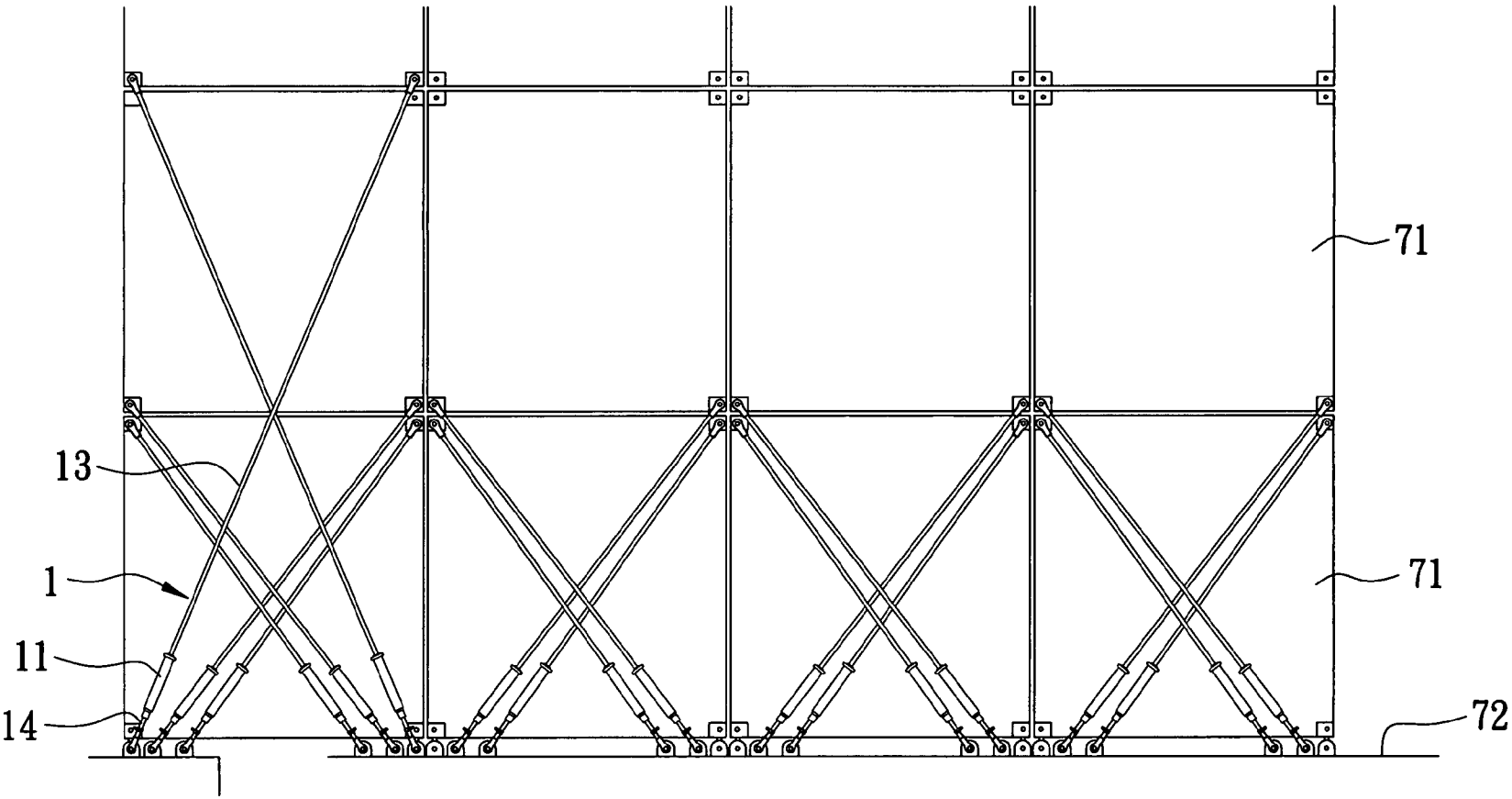
FIG. 1 PRIOR ART
FIG. 1 is a schematic view showing the conventional fastener assemblies securing a stack of containers on the deck of a ship.
Figure 2:
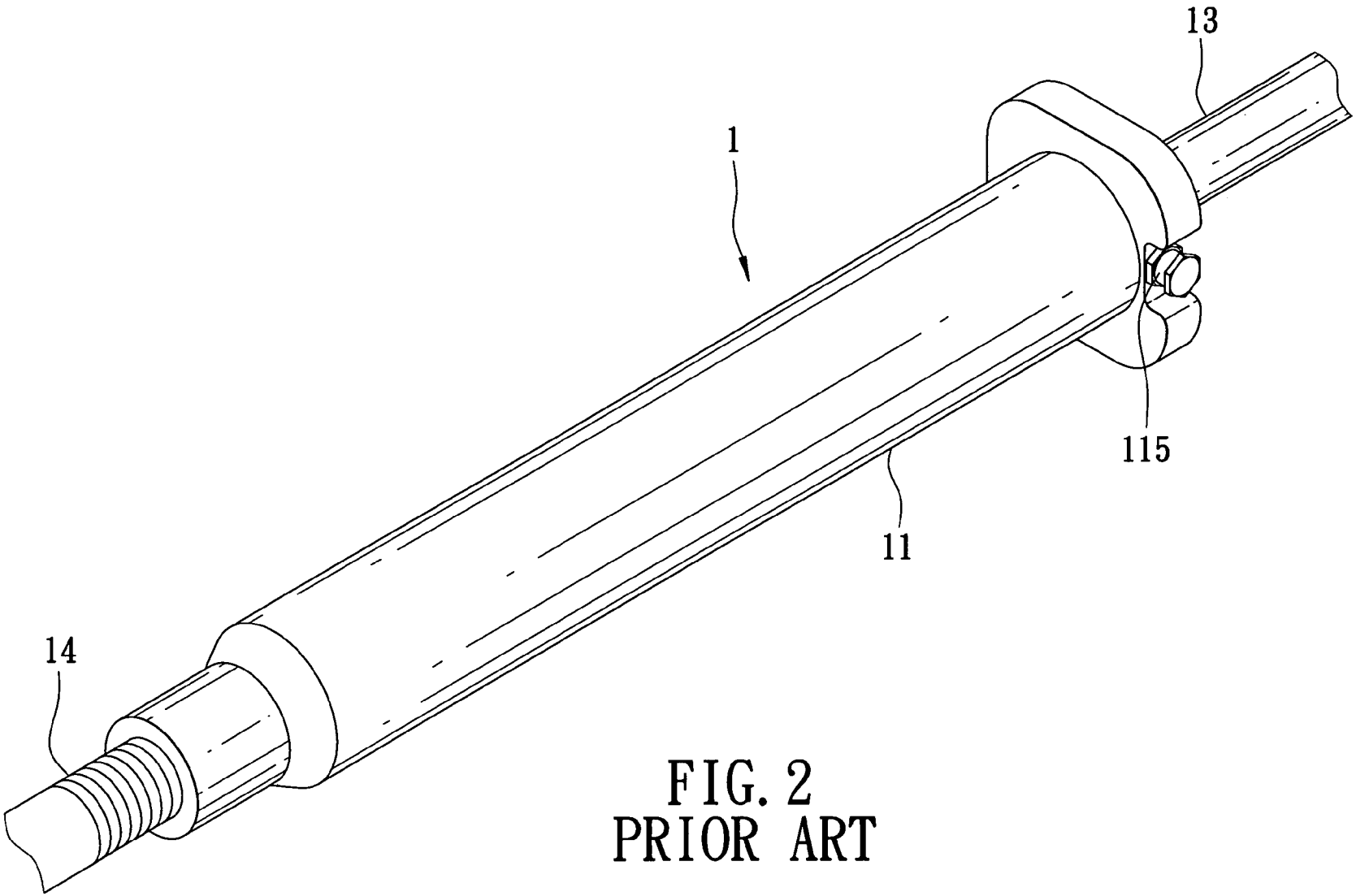
FIG. 2 PRIOR ART
FIG. 2 is a perspective view showing a conventional fastener.
Figure 3:
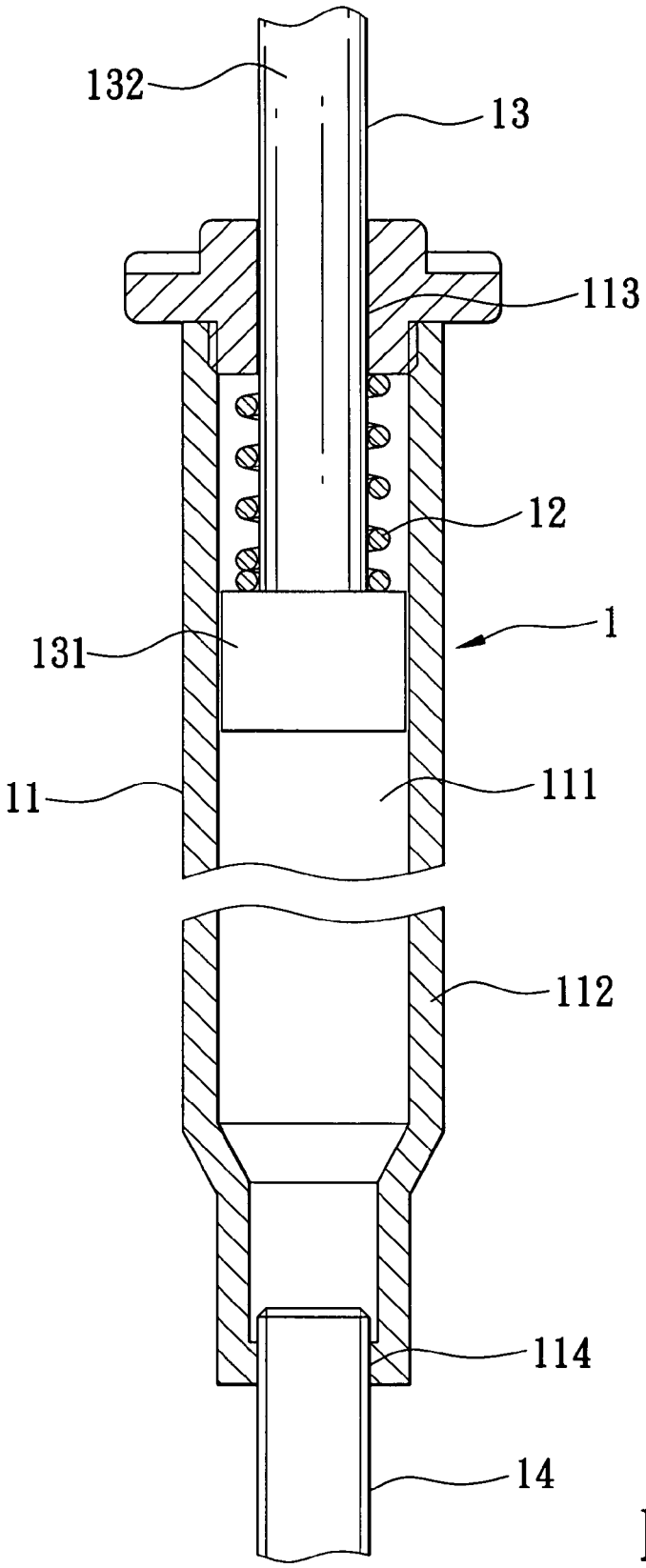
FIG. 3 PRIOR ART
FIG. 3 is a sectional view of the conventional fastener.
Figure 4:
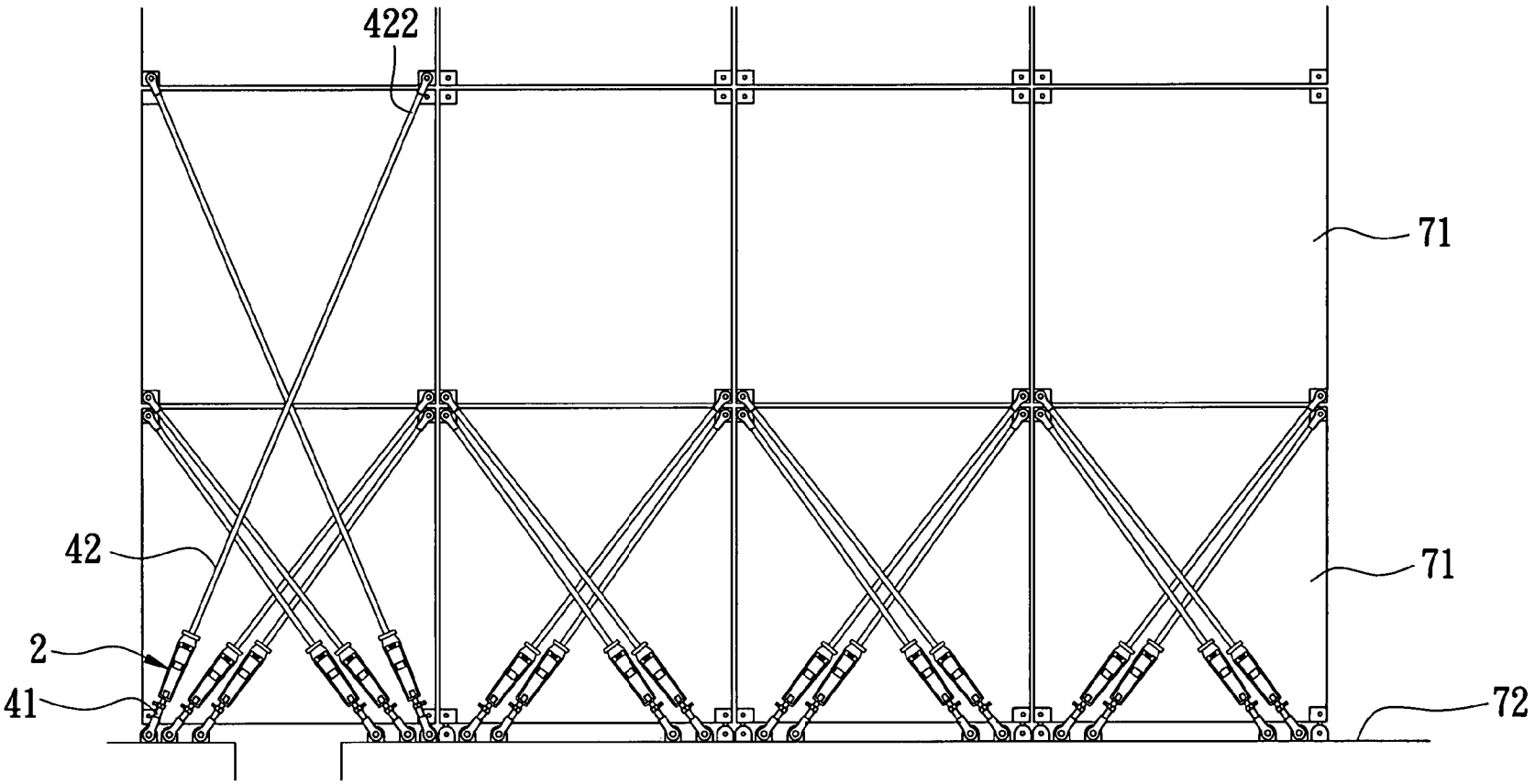
FIG. 4 is a schematic view showing a plurality of the fastener according to a first preferred embodiment of the present invention securing a stack of containers on the deck of a ship.
Figure 5:
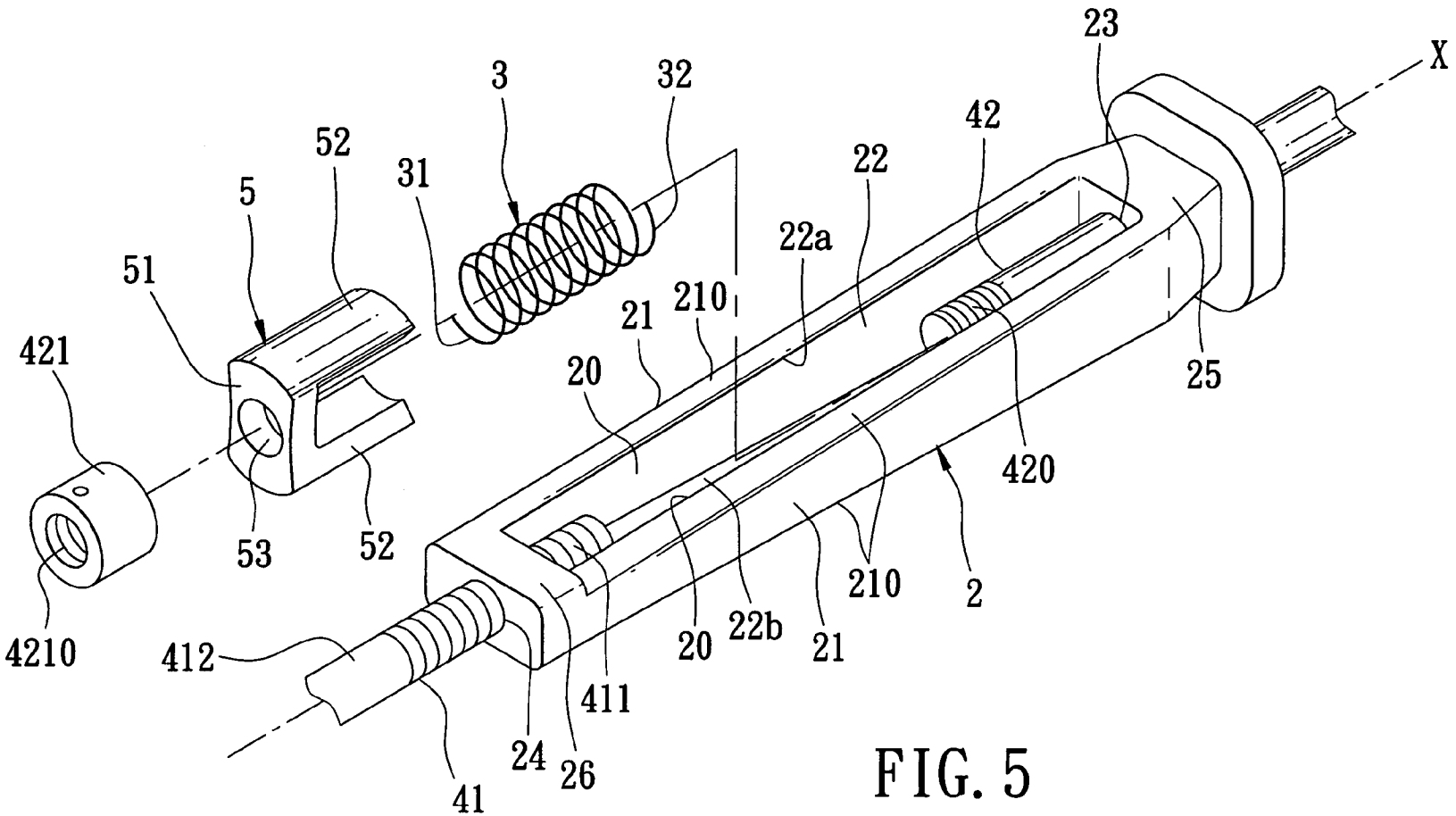
FIG. 5 is an exploded, perspective view of the first preferred embodiment.

With reference to FIGS. 4 and 5, a fastener for securing a container 71 on the deck 72 of a cargo ship or vessel according to a first preferred embodiment of the present invention generally comprises a hollow connector 2, an elastic element 3, a first pull rod 41, a second pull rod 42 and a limiting unit 5.

The hollow connector 2 includes opposed first end member 26 and second end member 25, a pair of spaced-apart frame rods 21 each having opposite ends connected to the first and second end members 26,25, and a receiving cavity 22 formed between the first and second end members 26,25 and defined by the frame rods 21. The first end member 26 has a threaded first bore 24 while the second end member 25 has a second bore 23. The frame rods 21 each have an inner face 20 confronting the receiving cavity 22 and two outer end faces 210 on the two opposite sides of the inner face 20, and the receiving cavity 22 has two opposite openings 22*a*,22*b* immediately adjacent the outer end faces 210. Thus, the receiving cavity 22 is open to expose the elements received therein, as will be described in more detail below.

The first pull rod 41 has a threaded first end 411 extending threadedly through the first bore 24 into the cavity 22 and a second end 412 for fastening to deck fittings on a ship. The second pull rod 42 extends slidably through the second bore 23 into the cavity 22, and has a threaded first end 420 to which a retaining head 421 is attached, and a second end 422 for fastening a cargo container (see FIG. 4). As shown in FIG. 5, the retaining head 421 has a threaded hole 4210 and the first end 420 of the second pull rod 42 is received therein in threaded engagement.

The elastic element 3, in the present embodiment, is a compression spring having two opposed ends 31,32 and being disposed around the second pull rod 42 within the cavity 22 between the second end member 25 and the retaining head 421 for biasing the retaining head 421 to move away from the second end member 25. The elastic element 3 and the retaining head 421 are exposed through either of the openings 22*a*,22*b* of the receiving cavity 22.

Figure 6:
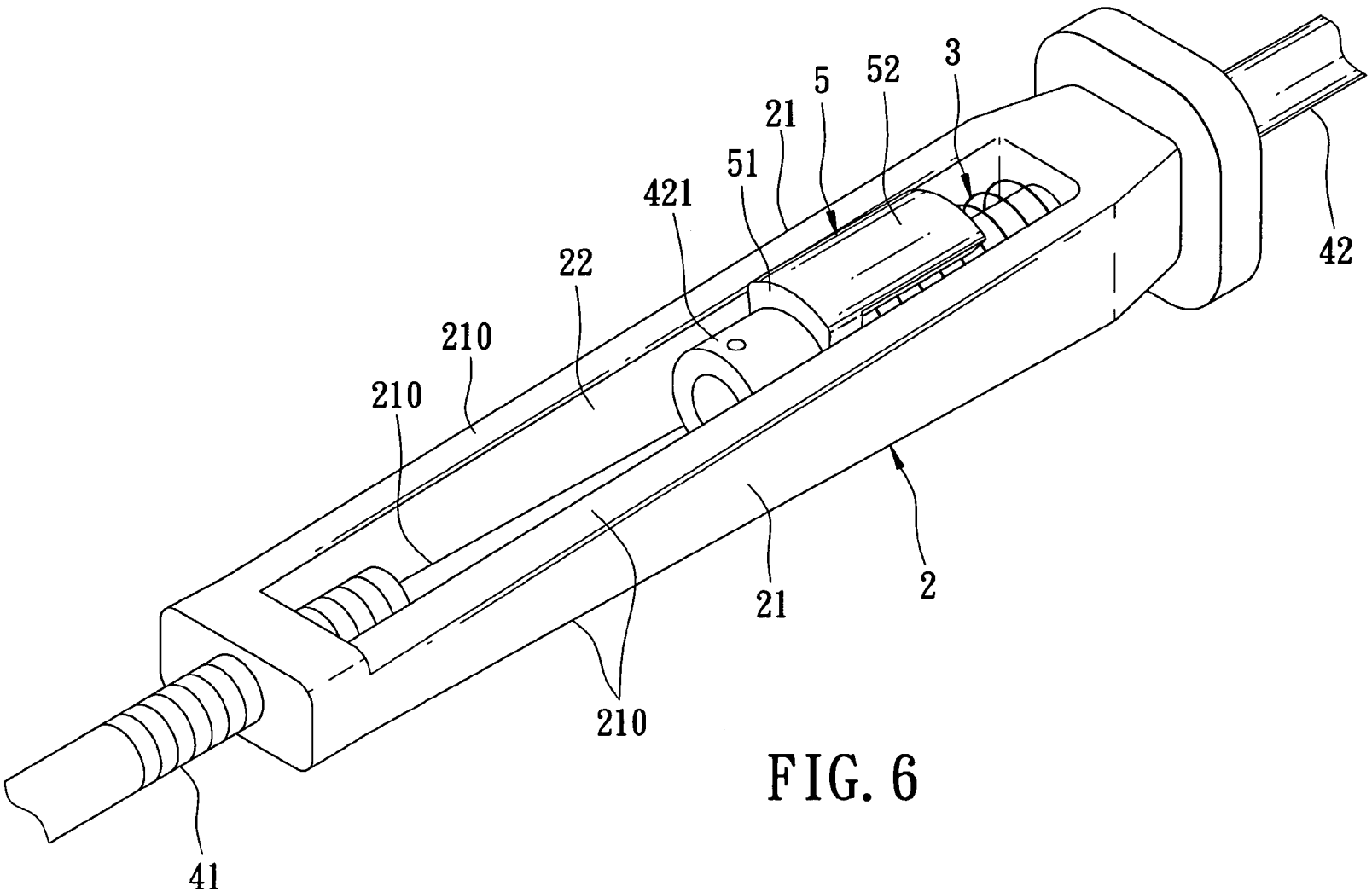
FIG. 6 is a perspective view of the first preferred embodiment in the assembled state.

The limiting unit 5 is confined in the receiving cavity 22 of the hollow connector 2 and is disposed between the retaining head 421 and the second end member 25 outwardly of the elastic element 3 to prevent the elastic element 3 from moving distortedly. The limiting unit 5 is displaceable only along an extension direction of the frame rods 21, designated X in the drawings (see FIGS. 5 and 8), and includes two opposed protective walls 52 and a base 51 bridging the protective walls 52 to define a recess for receiving the elastic element 3 with the second pull rod 42 sleeved therein. The protective walls 52 extend in the extension direction X on two opposite sides of the elastic element 3 and between the outer end faces 210 of the frame rods 21, thus partially covering the elastic element 3 exposed through the openings 22*a*,22*b* of the cavity 22, as best shown in FIG. 6. In the present embodiment, the base 51 is positioned between the retaining head 421 and the elastic element 3, in which one end 31 of the elastic element 3 abuts against the base 51 and the other end 32 of the elastic element 3 abuts against the second end member 25 of the hollow connector 2. Furthermore, the base 51 has a through-hole 53 aligned with the threaded hole 4210 of the retaining head 421, and the second pull rod 42 extends through the through-hole 53 of the base 51 and is threaded into the threaded hole 4210 of the retaining head 421.

Figure 7:
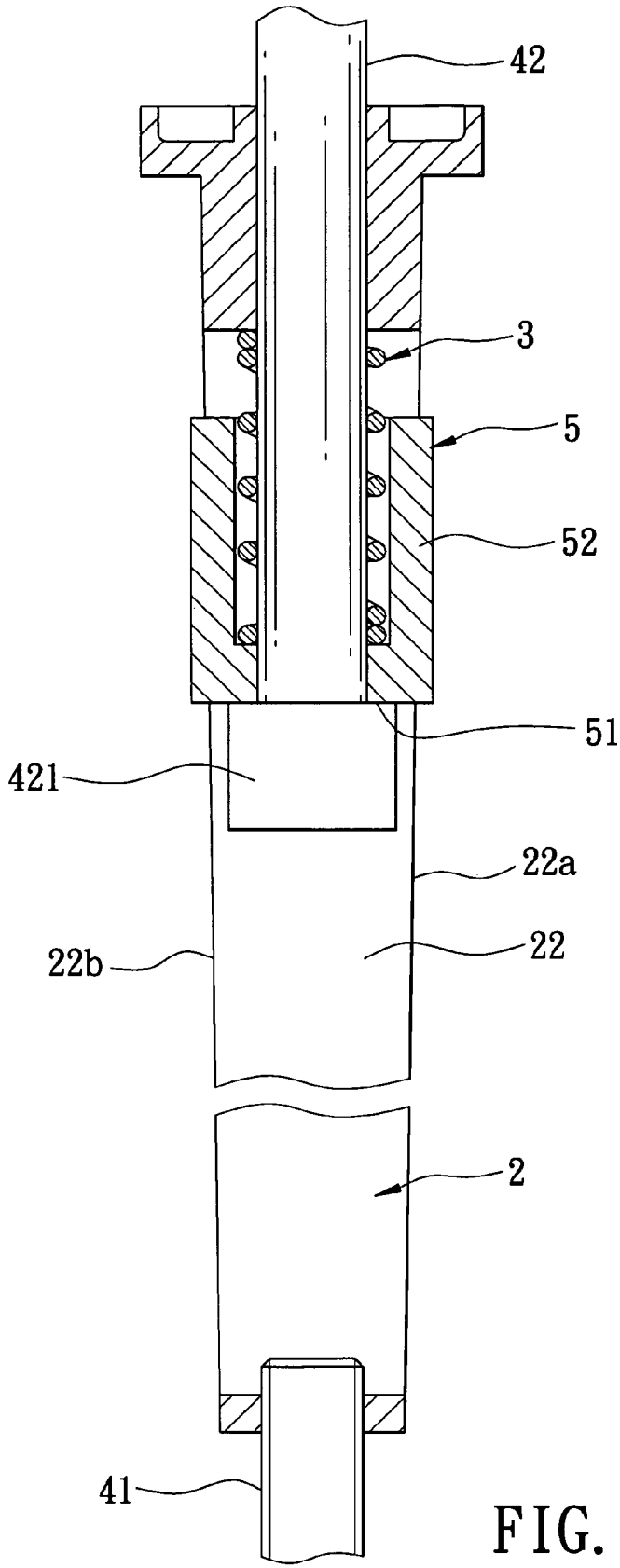
FIG. 7 is a sectional view of the first preferred embodiment.

With reference to FIGS. 6 and 7, when the second end 412 of the first pull rod 41 and the second end 422 of the second pull rod 42 are fastened to deck fittings and to a cargo container, respectively, on a ship, the elastic element 3 utilizes its own elastic restoring force to push against the base 51 of the limiting unit 5 and the retaining head 421 of the second pull rod 42 in a reverse direction to the pulling direction of the second pull rod 42, thereby providing a tightening tension between the first pull rod 41 and the second pull rod 42 which will not slacken during the swaying motion of the ship, and in turn preventing disengagement of any of the pull rods 41,42 from the hollow connector 2.

It is worth mentioning that, because the cavity 22 of the hollow connector 2 is open to expose the elastic element 3, various types of lubricants, e.g., a liquid lubricant or a viscous form of lubricant, may be applied thereto. Further, because the protective walls 52 of the limiting unit 5 are positioned over the openings 22*a*,22*b* of the cavity 22 such that the elastic element 3 is confined between the protective walls 52 and between the respective inner faces 20 of the frame rods 21, the elastic element 3 thus can extend or contract only within the confined space and will not be displaced or dislocated in the process of extension or contraction (compression) thereof. Certainly, the compression condition of the elastic element 3 may be directly viewed or observed through either of the openings 22*a*,22*b* of the cavity 22 of the hollow connector 2.

Figure 8:
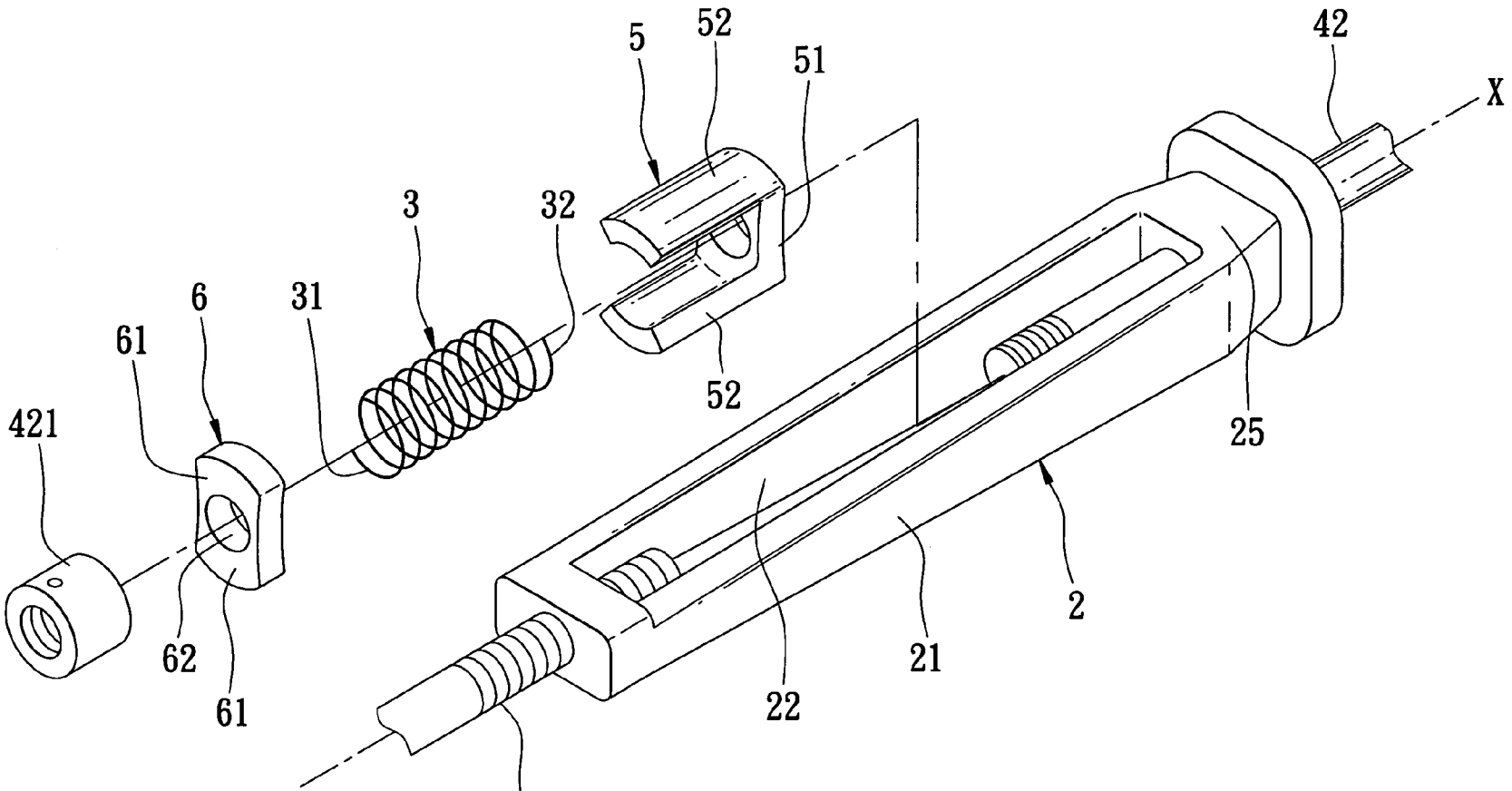
FIG. 8 is an exploded, perspective view showing a second preferred embodiment of the fastener according to the present invention.
Figure 9:
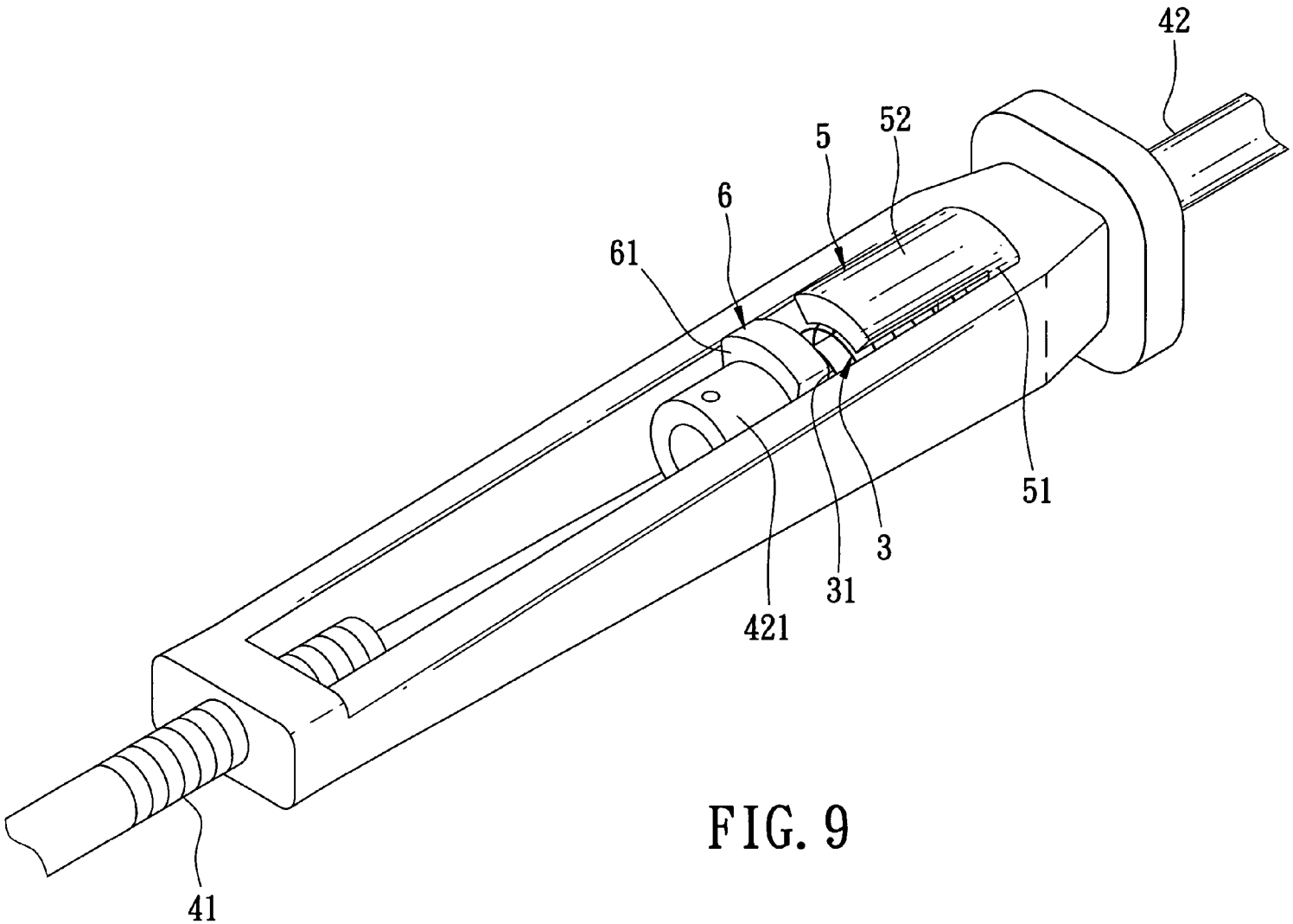
FIG. 9 is a perspective view showing the second preferred embodiment in the assembled state.
Figure 10:
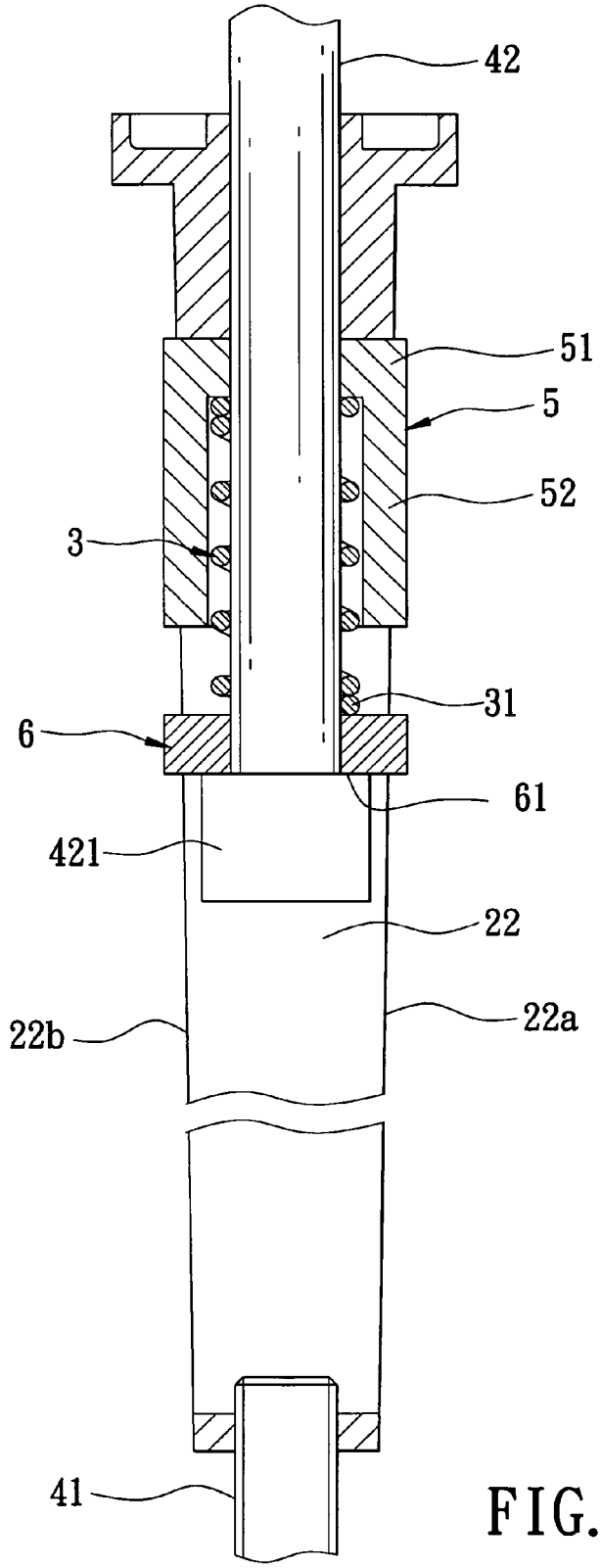
FIG. 10 is a sectional view of the second preferred embodiment.

With reference to FIGS. 8, 9 and 10, a second preferred embodiment of the fastener according to the present invention is shown. The second preferred embodiment is generally of the same structure as the first preferred embodiment and differs only in further including a pressure-equalizing member 6 and in having the limiting unit 5 reversed in position within the cavity 22. As shown, the pressure-equalizing member 6 is disposed between the retaining head 421 and the limiting unit 5, with the base 51 of the limiting unit 5 being positioned between the elastic element 3 and the second end member 25, such that the other end 32, instead of the one end 31, of the elastic element 3 abuts against the base 51. The pressure-equalizing member 6 has a through-hole 62 through which the second pull rod 42 extends, and is likewise displaceable only in the extension direction X. The pressure-equalizing member 6 has two opposed end portions 61 which are enlarged to protrude out of the two openings 22*a*,22*b* of the cavity 22, respectively, when the pressure-equalizing member 6 is positioned within the cavity 22, and is therefore of a larger cross-sectional area than that of the elastic element 3. The pressure-equalizing member 6 provides for even distribution of the pressure on the elastic element 3.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A fastener for securing a cargo container, comprising:

a hollow connector including opposed first and second end members, and a receiving cavity between said first and second end members, said first end member having a first bore and said second end member having a second bore;

a first pull rod having an end extending threadedly through said first bore into said receiving cavity;

a second pull rod extending threadedly through said second bore into said receiving cavity;

a retaining head attached to said second pull rod;

an elastic element disposed around said second pull rod between said second end member and said retaining head for biasing said retaining head to move away from said second end member, wherein said receiving cavity is open to expose said elastic element and said retaining head; and a limiting unit disposed between said retaining head and said second end member and outwardly of said elastic element for preventing said elastic element from moving distortedly.

2. The fastener as claimed in claim 1, wherein said elastic element is a compression spring.

3. The fastener as claimed in claim 2, wherein said hollow connector further includes a pair of spaced-apart frame rods each having two opposite ends connected to said first and second end members, respectively, each of said frame rods having an inner face confronting said receiving cavity and two opposite outer end faces on two opposite sides of said inner face, said receiving cavity having two opposite openings each of which is immediately adjacent to one of said outer end faces.

4. The fastener as claimed in claim 3, wherein said limiting unit includes two opposed protective walls which extend in an extension direction of said second pull rod on two opposite sides of said compression spring and between said outer end faces of said frame rods, and a base bridging said protective walls and being sleeved onto said second pull rod.

5. The fastener as claimed in claim 4, wherein said base is positioned between said retaining head and said compression spring.

6. The fastener as claimed in claim 4, wherein said base is positioned between said spring and said second end member.

7. The fastener as claimed in claim 6, further comprising a pressure-equalizing member disposed between said retaining head and said compression spring, said pressure-equalizing member evenly distributing the pressure on said compression spring.

8. The fastener as claimed in claim 7, wherein said pressure-equalizing member has two end portions protruding out of said two opposite openings of said receiving cavity, respectively, and has a larger cross-sectional area than a cross-section of said compression spring.

* * * * *